US006234919B1

(12) United States Patent
Mizeracki et al.

(10) Patent No.: US 6,234,919 B1
(45) Date of Patent: May 22, 2001

(54) TABLE TENNIS HANDLE-LESS RACQUET AND MULTIPURPOSE COMBINATION TABLE

(76) Inventors: Marion Tom Mizeracki, 39 Bunker Hill La., Russellville, AR (US) 72802; Martin Robert Mizeracki, 3301 Meadow Wood La., Bedford, TX (US) 76021

( * ) Notice: Subject to any disclaimer, the term of this patent is extended or adjusted under 35 U.S.C. 154(b) by 0 days.

(21) Appl. No.: 09/401,255

(22) Filed: Sep. 23, 1999

(51) Int. Cl.[7] ..... A63B 67/04

(52) U.S. Cl. ..... 473/496; 473/435; 473/470; 108/170

(58) Field of Search ..... 273/309; 473/496, 473/491, FOR 113, 4, 10, 14, 15; 108/93–95, 62–63, 96; 254/100

(56) References Cited

U.S. PATENT DOCUMENTS 512,337 * 1/1894 Standen ..... 473/10
2,911,217 * 11/1959 Hirsch et al. ..... 473/435
3,318,269 * 5/1967 Kinn ..... 108/170
4,300,766 * 11/1981 Haynes ..... 273/108.1
4,583,467 * 4/1986 Tiffany ..... 108/19
5,074,556 * 12/1991 Loeppky et al. ..... 273/108.5
5,372,364 * 12/1994 Arroyo ..... 273/108.5
5,451,046 * 9/1995 Batton ..... 473/470
5,704,683 * 1/1998 Cooper et al. ..... 297/124

* cited by examiner

*Primary Examiner*—Jeanette Chapman
*Assistant Examiner*—Mitra Aryanpour

(57) ABSTRACT

A table tennis handle-less paddle or racquet, and a multipurpose sport & entertainment game-study convertible table are disclosed. A racquet is characterized by combination of two separate impact surfaces, between which a players hand is inserted. The accessories and games are specifically designed as an integrated package, to develop motor skills for the youngest players, and to facilitate learning table tennis, starting from age five to six. A concept of novel hardware is also applicable to older children and adults as well. A multipurpose convertible table is constructed to serve as a game apparatus (table tennis or surface propelled puck game), or as a student study-work fixture.

4 Claims, 5 Drawing Sheets

TABLE TENNIS HANDLE-LESS RACQUET AND MULTIPURPOSE COMBINATION TABLE

FIELD OF THE INVENTION

This invention relates to a table tennis handle-less racquet (paddle, racket), and a table tennis convertible table. The table is designed to serve as a multipurpose game-study convertible apparatus. The invention is essentially dedicated to children. A racquet is characterized by combination of two separate impact surfaces, between which a player's hand is inserted. A table is constructed to serve as a game apparatus (table tennis or surface propelled puck game), or as a student study-work fixture.

BACKGROUND OF THE INVENTION

The physical characteristics of table tennis equipment and game playing techniques have been refined, over the last few decades. Yet, new hardware concepts and new means to facilitate learning the game skills are desirable. A conventional table tennis racquet requires tedious training in order to be proficient, and a conventional table is not sized for younger children. There is a need to encourage the youngest individuals to start playing as early as five or six. Therefore, the novel challenges are introduced in this invention to attract beginners and facilitate learning basics. The table tennis game can be played by the youngest players using the classic international rules, however, a time limit of 20 minutes, or score of 21, can be lowered during competition.

Another key goal of this invention, an integrated multifaceted system, is to promote child's uniform growth early, when the body and brain are most adaptable. Balanced growth appears to be essential, in many instances vital, in respect to muscles, bones, and most importantly, neurological system affecting brain development. The departure from conventional dimensions and materials cannot be considered as relevant in this case. For those who would like to play and compete in classic table tennis later on, the conceived system can be treated as a developmental and training tool. We may assume that when the proposed novelty is introduced, it will gain wider recognition and acceptance in the future, benefiting younger generations.

This invention's objective is to offer new solutions for the classic table tennis (ping-pong) equipment, new avenues to use it, and enhance various physiological functions. The design offers a simpler structure of a racquet in order to minimize it's weight and accommodate a small hand. This feature overrides the long sought quest for a conventional racquet, the superior performance of the impact surface—in hands of a competing "pro". For those who did not succeed to achieve a high level of motor skills in both hands, frequent use of the non-dominant hands, or, playing wearing the racquets on both hands, may be exceptionally beneficial.

The major focus of this invention is on the development of overall motor skills of a player, and use of the non-dominant (non-preferred) hand. Humans strive for challenges—and this is particularly applicable to maturing young people. Greater utilization of the non-dominant hand can stimulate uniform body growth, balanced brain development, and proper hand-eye neural lateralization. Therefore, also using the non-dominant hand for playing table tennis and "Tack-a-Pack" games is strongly recommended for the youngest players (age 5–6). The racquet is accommodated in different ways to fit either a user's right or left hand. Note: Use of the non-dominant hand for table games can be commenced when the dominant hand is already skilled in a game (table tennis or TAP), to allow for transfer of the learned skill from one hand to another.

DESCRIPTION OF PRIOR ART

Numerous patents have explored the original concept of splitting the game paddle impact surfaces, to accommodate a hand within the separated parts, the impact members, and remove the handle altogether. The modified feature, where a racquet impact surface is an extension of hands surface, supports more natural player's interaction with a ball. This improvement and use of the flexible tie between separated members makes the design unobvious. This invention overcomes some flaws of previous designs, changes the philosophy of training, and introduces more diversity into entertainment.

A concept of a handle-less paddle is noted in the prior art. Sweet et al, U.S. Pat. No. 4,148,483 switched from extended to internal handle. It represents only a minor change. Castelli U.S. Pat. No. 4,227,692 and Kraemer et al, U.S. Pat. No. 5,018,732, offer bulky and inconvenient designs. Wellen et al, U.S. Pat. No. 5,549,294, provides excellent fit, yet, a paddle is also oversized and the center of impact surface is too far from the center of a palm. The hand, in order to have good fit, does not need to be completely immobilized. It appears that so far the disclosed innovations did not find acceptance, It is hard for an experienced player to switch to a novel apparatus. It would be simpler to start playing the handle-less racquet of the proposed structure, and later switch to the conventional one, or use both devices alternatively.

Old art proposed a large number of variations in table tennis table configurations and features. A great effort has been expanded on folding tables—as in U.S. Pat. No. 3,756,166 (Piretti), U.S. Pat. No. 5,375,837 (Moreau), U.S. Pat. No. 2,911,217 (Hirsch), U.S. Pat. No. 3,318,269 (Kinn), and FR2729302 (Comilleau). A few patents offer convertible tables as in U.S. Pat. No. 3,886,913 (Zimmers), U.S. Pat. No. 4,345,758 (Kempf), or U.S. Pat. No. 5,704,683 (Cooper et al.), although simple and easily folded—yet still bulky or without radical novelty. The U.S. Pat. No. 4,583,467 (Tiffany) shows a simple convertible table dedicated to general use. The table convertible to a stand, disclosed in U.S. Pat. No. 512,337 (Standen), is dedicated to billiards.

This design attempts to go farther with compactness and diversification—and still preserves functional dedication. Further, the purpose of novel features is, to simplify dismantling a table and reconnecting it for an entirely different application, from game to study, or opposite. It introduces novelty into previous art, offering significant additional applications. The student desk, besides reading-writing etc., still can be used for table tennis (single player) training, or playing a recreational game within a smaller area. The table is to be formed of a lightweight metal, e.g. aluminum or fiberglass. This would include the surface, edges, and a core of honeycombed material—to minimize total weight.

SUMMARY OF THE INVENTION

A primary objective of this invention is to design an improved handle-less racquet and a convertible multipurpose table. The development of accessories and novel game table is dedicated, essentially, to the youngest players, starting from age 5–6. An improved handleless apparatus, due to its compactness, light-weightiness, and good fit, can enable a much younger child to start playing this sport. The racquet and table can be accommodated to older children, and adults as well.

Another objective of this invention is to expand functionality of the sport equipment, and integrate the new hardware and new table game with the conventional equipment—in order to add new challenges to a popular sport. The proposed table is easy to assemble, does not require special tools or skills, nor poses a major hazard during installation. A single table may be used by one player (during training), or, two, three, or four users can be accommodated for entertainment, or competition.

IN THE DRAWINGS

Figure 14:
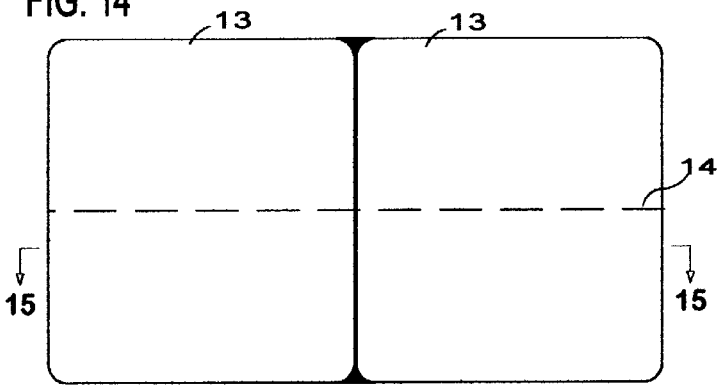
Figure 15:
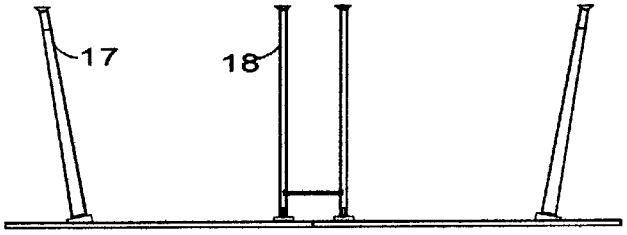
Figure 16:
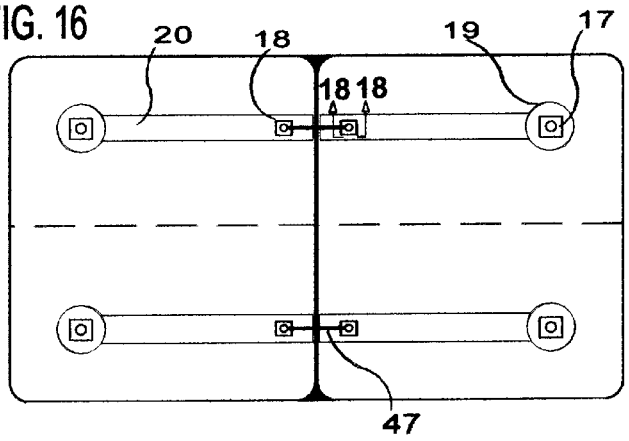

FIGS. 14, 15, and 16 show, respectively, a top plan, sectional side, and bottom plan view of the classic table modified for a young player.

Figure 17:
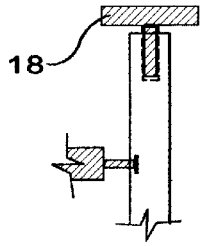
Figure 18:
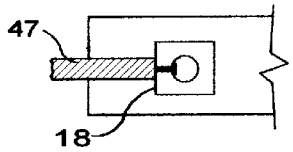
Figure 19:
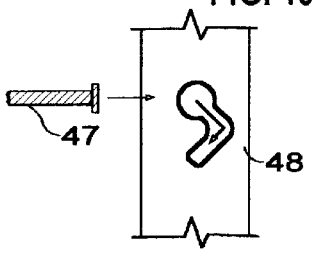

FIGS. 17, 18, and 19 are details of the connector (band or spring) attached to supporting legs.

Figure 20:
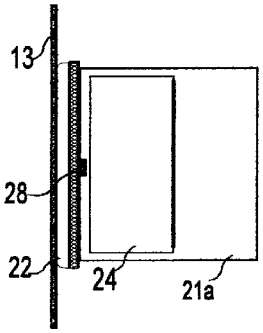
Figure 21:
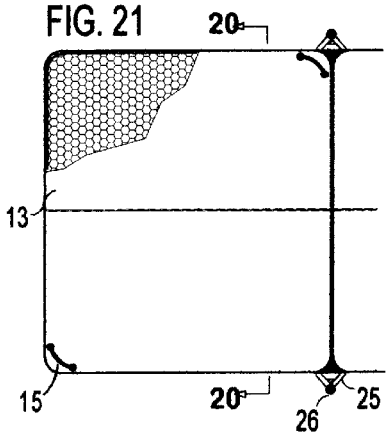

FIGS. 20 and 21 show, respectively, a sectional side view 20-20 and 21-21 of the table attached to the supporting combination stool-storage post, and a bottom plan view (with internal, honeycomb structural member).

Figure 22:
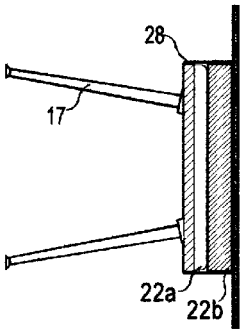
Figure 23:
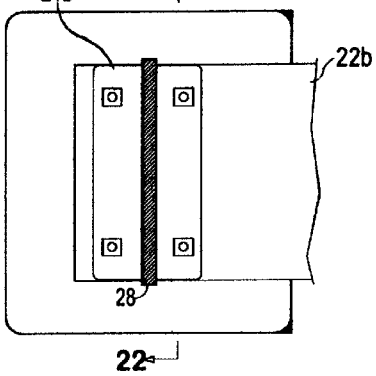

FIGS. 22 and 23 show, a sectional side view 22-22 and 23-23, and a bottom plan view of the table attached to the supporting stool.

Figure 24:
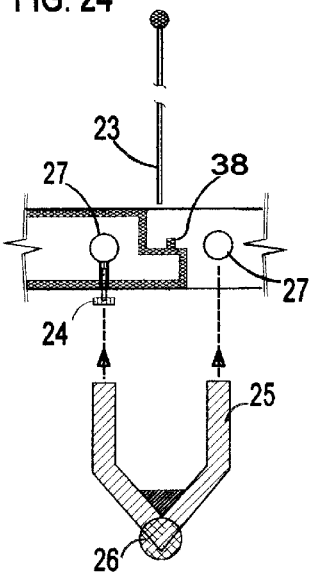

FIG. 24 shows a contact surface between two section of the table, a net, and a net holder with insertion points.

Figure 25A:
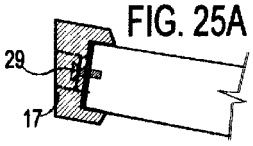
Figure 25B:
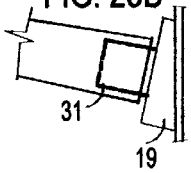

FIGS. 25A and 25B show, respectively, a table leg bottom segment, and a leg top attachment to the table.

Figure 26:
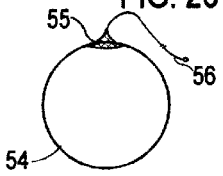

FIG. 26 depicts a training tool, the ping-pong ball with a provision for suspending.

Figure 27:
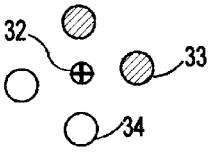
Figure 28A:
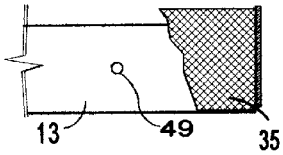
Figure 28B:
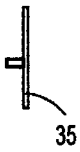
Figure 29A:
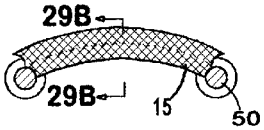
Figure 29B:
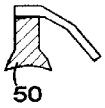

FIGS. 27, 28A/B, 29A/B, and 30A/B show the components of the novel game "Tack-a-Puck". They are, respectively: a puck with four disks, semi-rigid side strip (with a provision for the side strip), a cage, and a striking pad.

Figure 31:
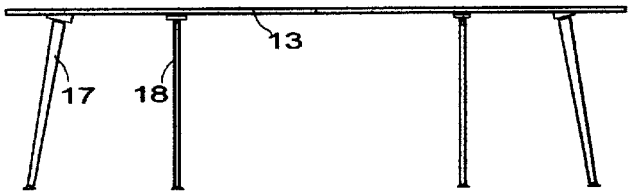
Figure 32:
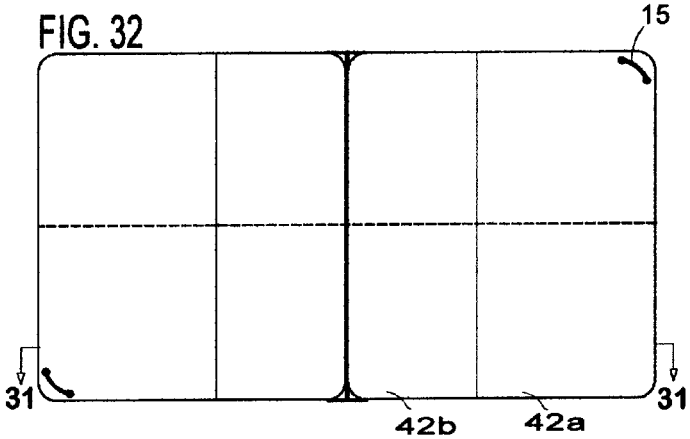
Figure 33:
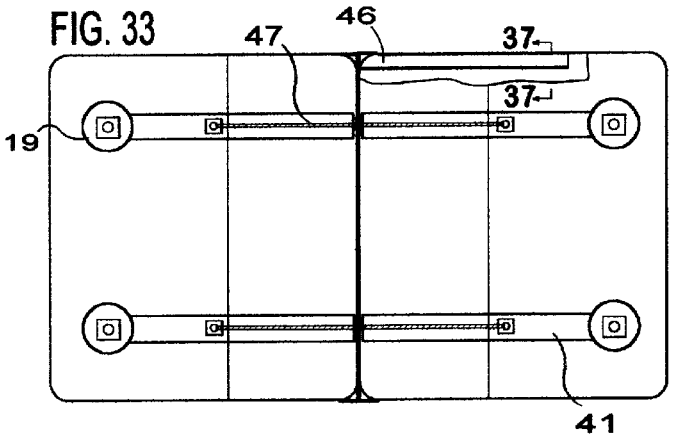

FIGS. 31, 32, and 33 show, respectively, a sectional side view 31-31 and 32-32, a top plan view, and bottom plan view of the combination four section table.

Figure 34:
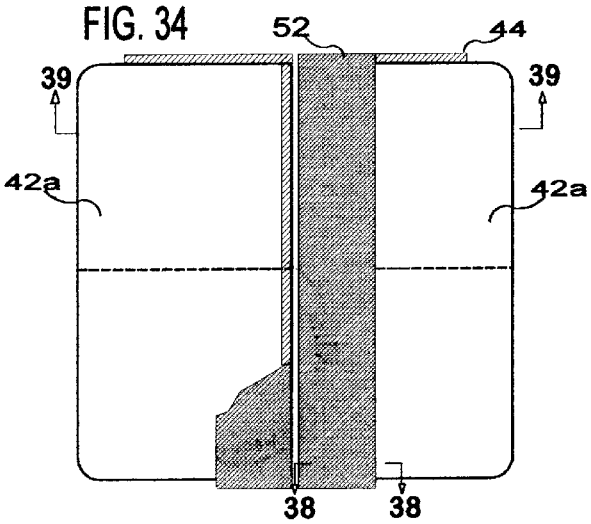

FIG. 34 shows a plan view of two parts of the table tennis table, transformed into two student desks.

Figure 35:
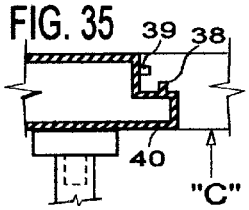
Figure 36:
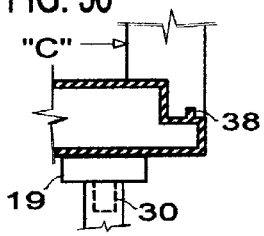

FIG. 35 and 36 show, a cross-sectional cutout view of connection between two sections of the combination table, normal, i.e. flat position, and a cutout view with a segment in a upright position, after conversion to the student desk.

Figure 37:
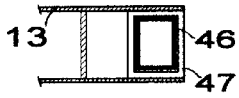

FIG. 37 depicts the reinforcing structural member, which supports two segments of the table in a horizontal plane.

Figure 38:
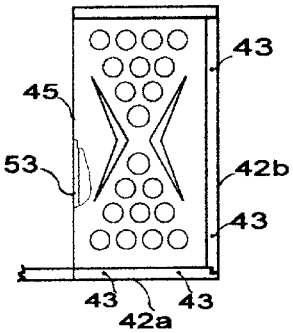

FIG. 38 shows a side view 38-38 of a panel supporting horizontal and vertical members of the student desk.

Figure 39:
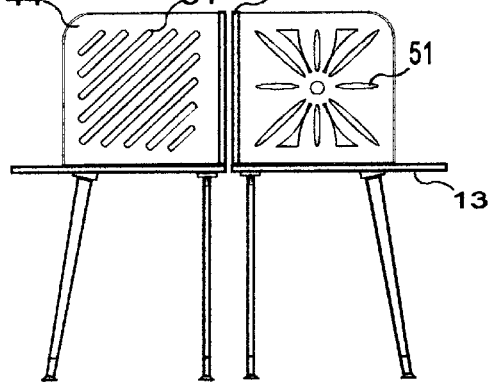

FIG. 39 shows a side plan view 39-39 of the combination table transformed into two study desks.

DESCRIPTION OF THE INVENTION

The present invention comprises the modified classic hardware, the table tennis (ping-pong) table and redesigned conventional accessories for playing table tennis, the racquet (paddle). The system is specifically designed to accommodate the youngest players (age 5–6) to a popular sport, and developing the skills which are considered to be of great importance at this particular age. The focus of the training and competitive playing, marathon, or any combination of seven options presented, is to allow a player to achieve body and neural balanced development. A multi-purpose table structure concept is conceived, so, the hardware can be easily reconfigured for other applications, and adopted to older children and adults. The height of the table can be easily raised by various means, e.g. blocks inserted under legs or cushions on stool tops. Besides its sport function (i.e. two or four player table tennis game using a conventional or modified racquet, single player training, and the disk-puck hockey game), the proposed hockey system allows use of the table as the student(s) study-work place, single or double.

The preferred design table tennis racquet, as conceived in this invention for a small hand, is circular (ca 12 cm, 4.75 inch), handle-less, with a provision for a hand inserted between two interconnected members. The racquet of a larger diameter, i.e. ca 14.5 (5.75 inch), can be used by older children and adults on the proposed "junior version", or using the standard table tennis table. And vice versa, the classic table tennis racquets can be used on the presented modified table, in order to provide diversity and expand a child's playing skills. The tables and racquets presented in this invention, do not conform to the standard tables and racquets currently in use in competitive playing. The difference is in dimensions, shape, and structure. The standard table dimensions are: 274 cm (9 feet) in length, 152.5 cm (5 feet) in width, and installed 76 cm (2.5 feet) above the floor. The multi-purpose table structure modified for younger players and proposed in this invention is about 10% narrower and shorter, and installed about 13% lower, than the conventional standardized table.

The preferred structure of the inner side of the layered racquet member comprises a plurality of holes made in an anodized aluminum, injection molded plastic, or composite disk, so that about fifty percent of material is removed. The perforated disk will be lighter and will provide a larger surface for adhesion of the impact surface, synthetic resin or rubber. The top and bottom impact members of the improved racquet are interconnected. Four preferred racquet embodiments are presented in this invention. In two preferred structures, depicted in FIGS. 1 and 5, and FIGS. 8–9, the members are connected using the flexible (rubber or plastic) elements, one version (FIGS. 3–4) uses rigid interconnections 8 and 10, and in one composition, FIGS. 10–11, the members are attached directly to the glove. In all options, both impact surfaces are not parallel. Instead, they retain the hand surface planes, i.e. they are slightly skewed. This arrangement offers a better fit and better precision of striking the ball. It also minimizes racquet weight—without jeopardizing striking capability in both modes of operation, i.e. forehand and backhand. In all four racquet embodiments enough room is provided for a hand, to remain in a comfortable position. The outer, impact surface of a racquet is to be a standard single layer of pimpled rubber, less than 2 mm thick, glued to the subsurface, a rigid (metal or reinforced plastic) disk.

Figure 1:
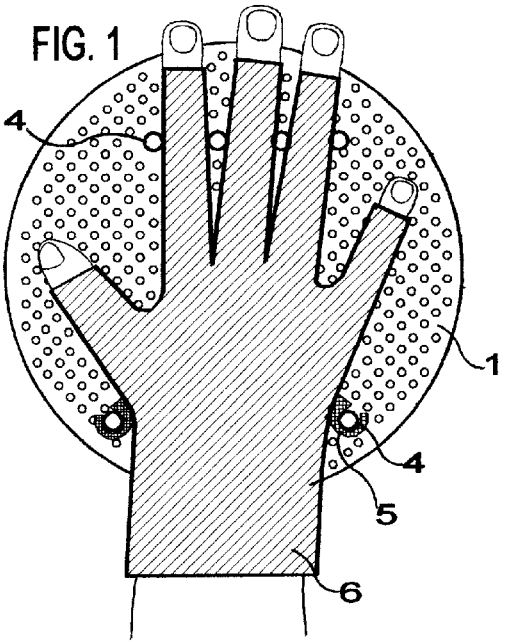
FIG. 1 is a plan view of an improved racquet with a gloved hand superimposed on bottom member.
Figure 2:
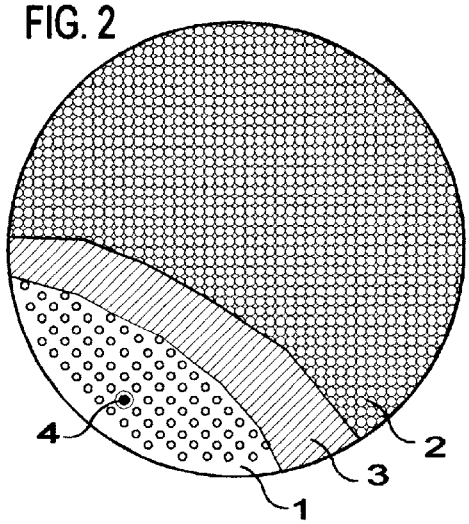
FIG. 2 is a top plan view of an improved racquet striking surface, with a cut-away view of the sandwich member.
Figure 5:
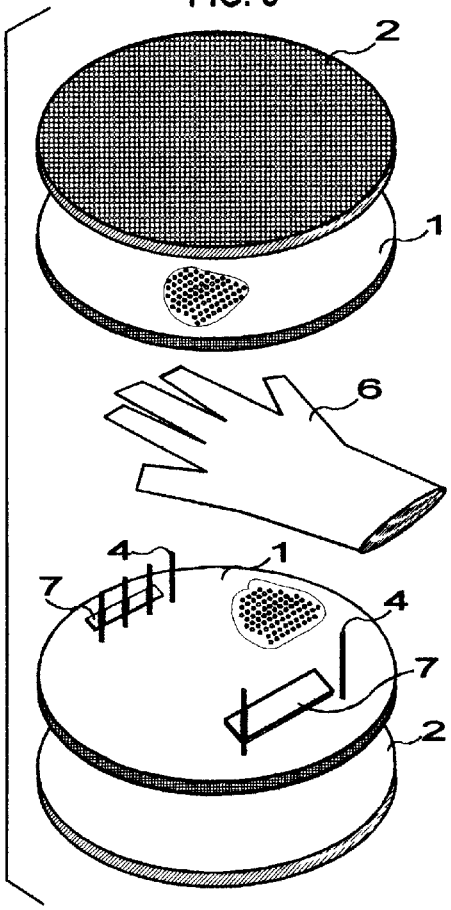
FIG. 5 is an exploded perspective view of the racquet shown in FIGS. 1–2.

The first embodiment of an improved racquet's inner surface with a gloved hand superimposed is depicted in FIG. 1. Six posts 4, made of rubber or soft plastic, provide flexible connection between both sandwiches. In the front, four posts properly spaced for the three middle fingers are installed—to assure good contact between hand and racquet. The posts are to be ca five millimeters at midpoint (slightly larger at ends), and less than 20 mm long for front posts and less than 35 mm for two rear posts. Additional semi-rigid spacers 5 (made of the same material) may be attached to two rear posts to accommodate a small hand. All components of the first preferred embodiment are shown in FIG. 5 (exploded perspective view). Two optional rectangular pads 7, made of porous material, rubber or plastic foam covered with washable material, can be attached to bottom and top surfaces. The pads can provide tighter fit of the hand in a few points.

Figure 3:
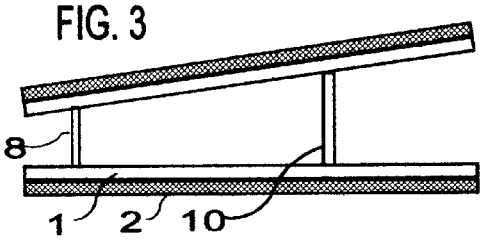
FIGS. 3–4 show, a sectional and side views with rigid spacers and provision for fingers.
Figure 4:
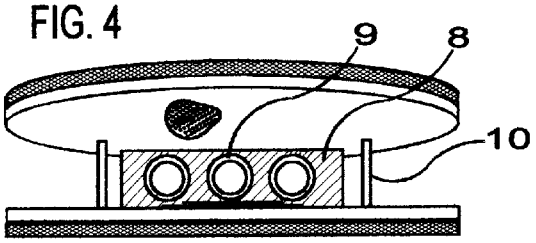
Figure 6A:
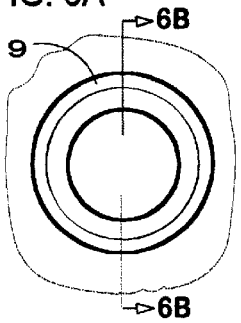
FIG. 6A is an insert (provision for one of the three fingers)
Figure 6B:
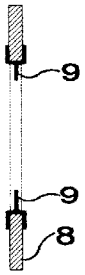
FIG. 6B is a section along line 6—6 of the front rigid spacer of the racquet shown in FIGS. 3/4.
Figure 7:
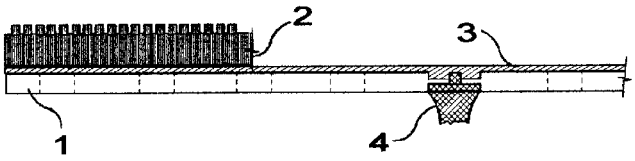
FIG. 7 is a cutaway view of the member with the flexible spacer attached to the internal disk.
Figure 8:
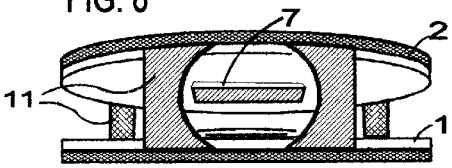
FIGS. 8-9 show, respectively, a sectional view and side view of an improved racquet with side flexible bands and cushions
Figure 9:
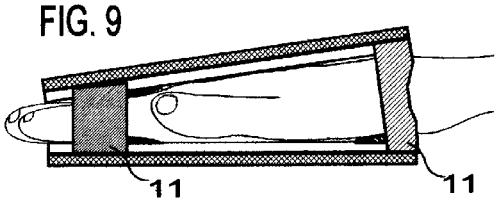
Figure 10:
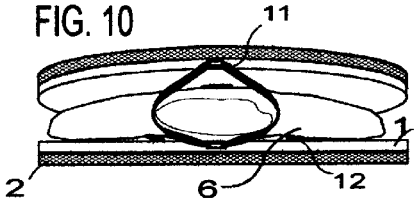
FIGS. 10–11 show, respectively, a sectional view and side view of an improved racquet with glove permanently attached to internal disks.
Figure 11:
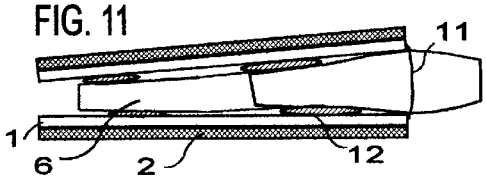
Figure 12:
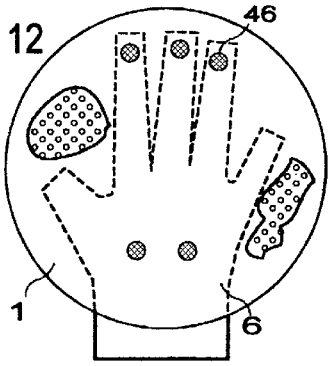
FIGS. 12 and 13 show the places where a glove is to be attached permanently to internal disks, respectively, top and bottom.
Figure 13:
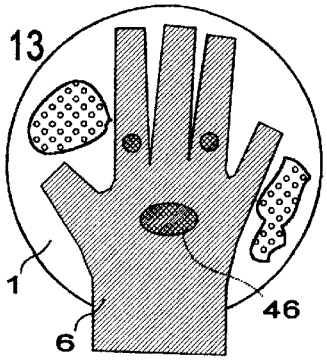

The front rigid spacer 8 of the second racquet embodiment shown in FIGS. 3–4, accommodates the three middle fingers of the hand. The soft, properly sized membrane (diaphragm) inserts, ref. FIG. 6, made of rubber or plastic, allow the fingers of various diameters to have good fit. The third embodiment, a racquet with side flexible bands and cushions, in a form of compressible pads, are shown in FIGS. 8–9, The side bands, about 2.5 cm (one inch) strips made of stretchable material, assure good fit and desired racquet control. The fourth embodiment of an improved racquet with a glove permanently attached to internal surfaces, by metal or plastic rivets, or glue, is depicted in FIGS. 10–11. This simple inexpensive solution minimizes the racquet's weight substantially. FIGS. 12 and 13 display the points of connection between a glove and inner disk, on both sides of a glove.

Another component covered by this design is a table, which also is adopted to younger players. This innovation offers a table of simple structure, easy to install and reconfigure, or dismantle. The classic, internationally recognized table tennis (ping-pong) table differs slightly from the table shown in FIGS. 14-15-16, modified in this design for the youngest player, age 5–6. A conventional table is 274 cm (9 feet) in length, and 152.5 cm (5 feet) in width, and table top 76 cm (2.5 feet ) above the floor. The suggested dimensions for the presented modified table are: 243.5 cm (8 feet) by 135.5 cm (4.5 feet). And, the playing surface installed 66 cm (2 feet and 2 inches) above the floor. The table corners are slightly rounded for safety reasons. The preferred honey-comb skeleton structure, to which surface panels are attached is the best option, in order to minimize the weight and facilitate installation. Both components, i.e. skeleton and surface panels, could be of the same material, extruded aluminum or reinforced fiberglass. The playing surface should be painted, dark mat, preferably blue (to differentiate from standard green), with a standard white line 2 cm (¾ inch) wide along the edges, and 3 mm (118 inch) wide line for double game division.

Three options for table support are considered in this design, (1) The classic tubular legs (FIGS. 25 and 26)—metal, PVC, or reinforced plastic and, (2) the combination stool-storage post (FIG. 20) with the soft cushion top 22, or, an attachment to the supporting conventional stool (FIG. 22) with the soft cushion top 22*b*. Table leg bottom tubular segment, and leg top attachment to the table are depicted in FIGS. 25A and 25B. External legs, i.e. adjacent to player, have a larger diameter at the top portion, and are positioned at an angle to increase stability of the table structure. The structural member 19 attached to the bottom surface provides a base for legs. The inner tubular non-skewed legs (ref. FIGS. 15 and 16) can be easily interconnected to provide structural rigidity, when both, mirror-image table parts, are set-up for a table tennis game. The details of the tie 47, inserts made of metal spring, flexible band, or a strip with the ratchet mechanism, and its connection to the leg, are shown in FIGS. 17, 18, and 19. The stool (FIGS. 20 and 22) can be attached to the table with straps 28, and hold a table top section 13. Or, it can be used as furniture, a classic bench for two—a practical option, when the table is not used for playing, and must be taken apart and stored.

The first (larger, stationary portion) and second (smaller, removable) table segments are connected rigidly, horizontally—when used for game playing, or, perpendicularly—when transformed into a student desk. A single table can allow creation of two independent student desks. FIGS. 31, 32, and 33, show, respectively, a sectional side view, a top plan view, and bottom plan view of the combination table. The table, transformed into two student desks is shown in FIGS. 34 and 39. The structural member 46, hollow, of rectangular shape, provides reinforcement for both table sections (ref FIGS. 33 and 37). In order to transform the game table into a student desk(s), the net holder must be removed, two parts of the table disconnected, and smaller segments in each table part, disengaged and removed. FIG. 35 shows a cross-sectional cutout view of a connection between two sections of the combination table. The smaller segment, when turned up-side down, will fit into the stationary segment, vertically (ref. FIG. 36). Note transposition of the surface "C". The notches 38 provide a means to engage and lock both parts. Two side panels and one top auxiliary panel provide support for the vertical segment. These three supporting panels 44, 45, and 52, preferably made of transparent or semi-transparent plexi-glass, or material identical to main structural components, are to be perforated, Metal edge protection and reinforcement 53 (FIG. 38) are to be provided when plexi-glass is not of sufficient thickness. The purpose of perforations 51, in various patterns (as shown in FIGS. 38 and 39), is to make the panels lighter, provide maximum illumination from other sources, and to achieve a better esthetic accent. All three supporting panels, when used to construct the student desk, can be prefabricated also as a single structure—to facilitate assembly.

The table tennis net 23 (FIG. 24), for this design, has conventional style and dimensions, i.e. suspended 15.25 cm (6 in.) high, and the outside limits of the posts 26 being 15.25 cm outside the side lines. The novel net holders are part of the fork-like inserts 25. The net holders serve also as connectors between two table segments, providing desired overall rigidity. After insertion of the posts, their position can be adjusted to stretch the net, and secured later in the desired position by a wing nut 24 at the bottom of the table. The table tennis ball, as FIG. 26 shows may be used as a training tool. The ball 54 can be suspended near wall or in open area, via a cup 55 and string or fishing line 56. This simple devise can be used for introduction to playing or as a exercising tool.

Figure 30A:
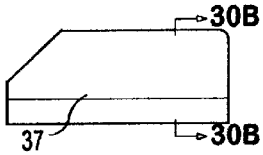
Figure 30B:
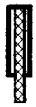

FIGS. 27 through 30A/B show the components of the novel game "Tack-a-Puck", i.e. a puck with four disks, the side strip, the cage, and a striking pad. The "TACK-A-PUCK" (TAP), is a table surface game, dedicated to entertainment and motor skills development. The game is played shooting (propelled by sliding on the surface) a small (ca 15 mm, 0.6 inch diameter), round, Teflon (or equivalent) covered metal disk 32, into the opponent's cage 15 (FIGS. 21 and 32), ca 5 cm, 2 inch wide. Two sets, two each, intermediate disks 33 (34), slightly larger (ca 23 mm. 0.9 inch diameter) and heavier than a puck, are to be used to propel a scoring object 32 toward a cage, using a hand-held striking blade 37. The blade 37 (ref. FIG. 30A), ca 10 cm by 3 cm (ca 4 by 1.2 inch) is to be made of plastic or wood. Various 'tacking', or meandering techniques (resembling yacht tacking), including straight, zigzag, ricochet, and angle-shot, can be used to play. Double intermediate disks are used by each player to make a game more diversified. Two cages are to be attached to the table top surface (with suction cups 50) in the opposite corners of the table, and siding strips attached to table sides, to keep the moving disks on the table surface. Ref. to FIG. 28A/B: the semi-rigid plastic strip 35, can be attached to table sides via pins inserted into holes 49.

The TAP game, time or score limited, can be initiated after drawing a player who starts a game. In order to score a point the puck must land in the opponents cage, propelled on the surface by any one of the two auxiliary disks, when struck with a hand-held blade. The difficulty level of game can be increased, by: (1) Creating a "no-parking-zone" for an inactive auxiliary disk of a Player 1, in vicinity of a cage of a Player 2, (2) Not permitting opponent's disk to have contact with another disk, unless it touches a puck first after the strike, (3) Using the non-dominant hand by both players during a game, and, (4) Striking the "penalty shot" from a distant place, for example from own cage area, with or without an obstruction along the shooting line. The TAP game can be played in any of the three areas, table surfaces, i.e. full table (with the net removed)—ref. FIG. 32, each table segment (half size)—ref. FIG. 21, and desk area (after folding the table). Note that the table can accommodate two teams of TAP players at a time.

The subject game table can also be applied for the combination 'marathon' "Seven-in-One" series of competing games, comprising, the use of conventional table tennis racquets, modified handle-less racquets, and "Tack-a-puck" game—all played, once using the dominant and once the non-dominant hand. The seventh competition can be exercised wearing the handle-less racquets on both hands, or holding the conventional paddles in both hands.

The present invention provides a set of accessories and apparatus dedicated to entertainment and unique way for a growing body's balanced development, and with a novel provision conceived for a game table, to serve also as a study-work fixture for students. The invention has been described referring to a series of examples depicted in the drawings, to illustrate the novelty, physical characteristics, and suggested configuration. Some modifications may be introduced in the conceptual design, preserving assumptions and principles presented in the claims.

We claim:

1. A combined multi-purpose table structure and game accessories comprising:

said multi-purpose table structure comprising first and second student study desks which together are convertible to one of a surface for a table tennis game or a surface for a propelled puck game, said multi-purpose table structure further comprising:

said first and second student study desks each including:

a horizontal segment and lightweight vertical segments releasably interlocked with the horizontal segment along butt joints therebetween to form a main segment with a top, bottom and sides;

a perforated reinforced panel formed from translucent material releasably embracing the top and sides of said main segment; and a stationary horizontal segment support member comprising a stand-alone multi-purpose stool attached to a bottom surface of said main segment by a releasable binding fastener;

and further including insertable structural reinforcements for making said multi-purpose table structure rigid;

wherein said main segment of said first and second student study desks of said multi-purpose table structure can be easily taken apart and converted to function as one of a surface for a table tennis game or a surface for a propelled puck game for use by children, and wherein the game accessories comprise:

means for playing a table tennis game; and means for playing a propelled puck game.

2. The combined multi-purpose table structure and game accessories of claim 1, wherein said means for playing a propelled puck game comprises:

a round, low friction material covered metal disc puck;

two different colored sets of intermediate metal disks each used to propel said puck on said table surface;

two hand-held striking blades to propel the two different colored sets of intermediate metal disks;

a plastic strip releasably attachable to said table surface sides for extending about the table surface; and two removable cages removably attachable to the table surface in opposing corners of the table surface using suction cups.

3. The combined multi-purpose table structure and game accessories of claim 1, wherein said means for playing a table tennis game comprises:

a table tennis net removably attachable to said table surface;

a table tennis ball; and two table tennis racquets.

4. The combined multi-purpose table structure and game accessories of claim 3, wherein said table tennis racquets are handle-less.

* * * * *